US005487942A

United States Patent [19]

Gomibuchi

[11] Patent Number: 5,487,942

[45] Date of Patent: Jan. 30, 1996

[54] CARBOXYL GROUP-MODIFIED ACRYLONITRILE FIBER AND PROCESS OF PRODUCING SAME

[75] Inventor: Reizo Gomibuchi, Uji, Japan

[73] Assignee: Nippon Sanmo Sensyoku Co., Ltd., Japan

[21] Appl. No.: 329,081

[22] Filed: Oct. 25, 1994

Related U.S. Application Data

[62] Division of Ser. No. 234,125, Apr. 28, 1994, abandoned.

[51] Int. Cl.[6] ..... D02G 3/00

[52] U.S. Cl. ..... 428/364; 428/375; 428/394; 8/115.55; 8/115.56; 525/301; 525/303

[58] Field of Search ..... 428/375, 364, 428/394; 8/DIG. 18, 115.54, 115.56, 115.62, 115.55; 525/301, 303

[56] References Cited

U.S. PATENT DOCUMENTS

| | | | |
|---|---|---|---|
| 3,846,386 | 11/1974 | Yamamoto et al. | 260/80.72 |
| 3,984,515 | 10/1976 | Mommaerts et al. | 264/182 |
| 4,107,129 | 8/1978 | Tanaka et al. | 260/40 P |
| 4,151,151 | 4/1979 | Isley | 526/3 |
| 4,515,859 | 5/1985 | De Maria | 428/398 |
| 4,743,267 | 5/1988 | Dyer | 8/194 |
| 5,089,135 | 2/1992 | Yoneyama et al. | 210/500.23 |
| 5,168,004 | 1/1992 | Daumit et al. | 428/221 |
| 5,334,419 | 8/1994 | Minami et al. | 428/408 |

FOREIGN PATENT DOCUMENTS

| | | |
|---|---|---|
| 0189163 | 7/1986 | European Pat. Off. . |
| 0262405 | 4/1988 | European Pat. Off. . |
| 2384867 | 10/1978 | France . |
| 2387250 | 11/1978 | France . |

OTHER PUBLICATIONS

Textile Research Journal, vol. 59, No. 9, Sep. 1989, pp. 525–529.

Database WPI Week 9431, Derwent Pub. AN 94–253428.

*Primary Examiner*—Patrick J. Ryan
*Assistant Examiner*—J. M. Gray
*Attorney, Agent, or Firm*—Lorusso & Loud

[57] ABSTRACT

Cellulose or acrylonitrile fiber having methacrylic acid or hydroxyalkyl methacrylate graft-copolymerized in an amount of 3–60% by weight is disclosed. The graft fiber is produced by reacting methacrylic acid or a hydroxyalkyl methacrylate with cellulose or acrylonitrile fiber in an aqueous medium containing hydrogen peroxide and a ferrous salt.

3 Claims, No Drawings

CARBOXYL GROUP-MODIFIED ACRYLONITRILE FIBER AND PROCESS OF PRODUCING SAME

CROSS-REFERENCE TO RELATED APPLICATION

This application is a division of U.S. Ser. No. 08/234,125 filed Apr. 28, 1994, now abandoned.

BACKGROUND OF THE INVENTION

1. Field of the Invention

This invention relates generally to a fiber modified with carboxyl groups and, more specifically, to a cellulose or acrylonitrile fiber to which methacrylic acid or a hydroxyalkyl methacrylate is graft-copolymerized. The present invention is also directed to a process for producing such a modified fiber.

2. The Prior Art

One known method of introducing carboxyl groups into a cellulose fiber includes reacting monochloroacetic acid with the cellulose fiber. Because of the introduction of carboxylic groups, the cellulose fiber thus obtained has improved hydrophilicity and is capable of absorbing basic, bad odor substances such as amines and ammonia. The known method has, however, a problem that it is difficult to homogeneously react the monochloroacetic acid with a solid, bulky mass of cellulose fibers because the reaction is exothermic.

It is also known to introduce ether linkages into a cellulose fiber by reaction with a vinyl compound according to the Michael reaction. With this method, however, it is not possible to effectively introduce carboxyl groups into the cellulose fiber when an unsaturated carboxylic acid such as acrylic acid or maleic acid is used as the vinyl compound. Thus, in order to introduce carboxylic groups into the cellulose fiber by utilizing the Michael reaction, it is necessary to first react the cellulose fiber with acrylonitrile and to hydrolyze the cyano groups into carboxyl groups.

An acrylonitrile fiber has properties similar to wool but has a defect that the moisture or damp absorbing power is poor. No effective method is however known to impart hydrophilicity to the acrylonitrile fiber.

A method is known in which a vinyl monomer having an acidic group is graft-copolymerized to a polyester or polyamide fiber using am organic peroxide such as benzoyl peroxide.

SUMMARY OF THE INVENTION

In accordance with one aspect of the present invention there is provided a modified fiber comprising a substrate fiber selected from the group consisting of cellulose fibers and acrylonitrile-series fibers, and a graft comonomer graft-copolymerized to said substrate fiber in an amount of 3–60% by weight based on the weight of said substrate fiber, said graft comohomer being at least one member selected from the group consisting of methacrylic acid and hydroxyalkyl methacrylates.

In another aspect, the present invention provides a process for the production of a modified fiber comprising graft-copolymerizing a graft comonomer to a substrate fiber in an aqueous medium containing hydrogen peroxide and a source of ferrous ion, said substrate fiber being selected from the group consisting of cellulose fibers and acrylonitrile-series fibers, and said graft comonomer being at least one member selected from the group consisting of methacrylic acid and hydroxyalkyl methacrylates.

DESCRIPTION OF THE PREFERRED EMBODIMENTS

The present invention will now be described in detail below.

The substrate fiber used in the present invention, which is selected from cellulose fibers and acrylonitrile-series fibers, may be any desired form such as a yarn, a cotton, a woven or non-woven fabric, a filament or a tow. If desired, the substrate fiber may be used in combination with another fiber. The cellulose fiber may be, for example, cotton or hemp. The term "acrylonitrile-series fiber" used in the present specification and claims is intended to refer to a fiber formed of a homopolymer acrylonitrile or a copolymer of acrylonitrile with a vinyl comohomer. Examples of the vinyl comonomers include methyl acrylate, vinyl acetate, acrylic acid, methacrylic acid, vinyl chloride, vinylidene chloride, methylvinylpyridine, styrenesulfonic acid and mixtures thereof. The copolymer of acrylonitrile with the vinyl comonomer generally has a content of the acrylonitrile of at least 20% by weight, preferably 35–90% by weight.

To the substrate fiber is graft-copolymerized and linked a graft comohomer in an amount of 3–60% by weight based on the weight of the substrate fiber. The graft comonomer is selected from acrylic acid and hydroxyalkyl methacrylates such as 2-hydroxyethyl methacrylate and 2-hydroxypropyl methacrylate. When the substrate fiber is a cellulose fiber, the graft comonomer is preferably methacrylic acid and is graft-copolymerized thereto in an amount of preferably 5–30% by weight, more preferably 7–15% by weight. When the substrate fiber is an acrylonitrile-series fiber, the graft comonomer is preferably copolymerized in an amount of 5–40% by weight.

The modified fiber according to the present invention may be prepared by graft-copolymerizing the graft comonomer to the substrate fiber in an aqueous medium containing hydrogen peroxide and a source of ferrous ion.

The ferrous ions source is preferably a ferrous salt such as ferrous sulfate, ferrous chloride, ammonium ferrous sulfate or ferrous nitrate. The ferrous in salt is preferably present in the aqueous medium in an amount providing a ferrous ion concentration of 0.5–5 mmol/liter, more preferably 1.0–2.5 mmol/liter when the substrate fiber is a cellulose fiber and 0.7–1.6 mmol/liter when the substrate fiber is an acrylonitrile-series fiber.

The concentration of the hydrogen peroxide in the aqueous medium is preferably 0.01–0.1 mol/liter, more preferably 0.02–0.05 mol/liter when the substrate fiber is a cellulose fiber and 0.03–0.06 mol/liter when the substrate fiber is an acrylonitrile-series fiber. The hydrogen peroxide and the ferrous ion source together serve to accelerate the graft copolymerization.

The aqueous medium may contain an acid in an amount of 2–4 mmol/liter, preferably 2.5–3.5 mmol/liter, if desired. The acid serves to enhance the grafting rate of the graft comonomer. Examples of suitable acids include sulfuric acid, hydrochloric acid, phosphoric acid and formic acid. Further, the aqueous medium may further contain a sequestering agent such as EDTA, NTA or a phosphoric acid-type or sulfonic acid-type agent.

The graft comonomer is generally used in an amount of 5–100 parts by weight, preferably 10–60 parts by weight, per 100 parts by weight of the substrate fiber and wherein the weight ratio of said aqueous medium to said substrate fiber is generally 5:1 to 50:1, preferably 5:1 to 20:1 when the substrate fiber is a cellulose fiber and 5:1 to 15:1 when the substrate fiber is an acrylonitrile-series fiber.

The graft copolymerization is generally performed at a temperature and for a period of time so that the graft monomer is grafted to the substrate fiber in an amount of 3–60% by weight based on the weight of the substrate fiber. Preferably, the graft degree (weight percentage of the grafted comonomer based on the weight of the substrate fiber) is 5–30% by weight, more preferably 7–15% by weight, when a cellulose fiber is used as the substrate fiber. The graft degree is preferably 3–60% by weight, more preferably 5–40% by weight, when a methacrylonitrile-series fiber is used as the substrate fiber. The graft copolymerization is generally performed at a temperature of 40°–110° C. for 30–240 minutes. In the case of a cellulose fiber, the graft copolymerization is preferably performed at 40°–100° C. for 60–240 minutes, more preferably 40°–80° C. for 90–180 minutes. In the case of an acrylonitrile-series fiber, the graft copolymerization is preferably performed at 70°–110° C. for 30–180 minutes, more preferably 90°–100° C. for 60–90 minutes.

If desired, the carboxyl groups (-COOH) introduced into the substrate fiber by graft copolymerization of the graft comonomer may be converted into -COOM (M represents a cation) by reaction with a salt-forming cation. The cation may be, for example, sodium ion, calcium ion, ferrous ion, cupric ion, zinc ion, manganese ion, silver ion, quaternary ammonium ion or quaternary organic amine ion.

The process according to the present invention uses a ferrous salt in a very small amount. Therefore, the modified fibers is not discolored and no specific step for the removal of the ferrous salt is required. Further, the reaction conditions for the modification treatment may be easily controlled so that the graft copolymerization can be homogeneously performed. The modified fibers of the present invention have improved hydrophilicity and serve to function as a good adsorbent not only for basic, bad odor substances such as ammonia and amines, but also for metal ions.

The following examples will further illustrate the present invention. Percentages are by weight.

EXAMPLE 1

Into an aqueous solution (150 ml) containing 0.3% (0.03 mol/liter) of hydrogen peroxide, 0.03% (0.11 mmol/liter) of ammonium ferrous sulfate ($FeSO_4(NH_4)_2SO_4 \cdot 6H_2O$, Mohr's salt), 1.3% (0.15 mol/liter) of methacrylic acid, 0.03% (0.001 mol/liter) of a proprietary metal sequestering agent (CHELEST NTB® manufactured by Chelest Chemical Inc.) and 0.06% (0.003 mol/liter) of sulfuric acid (50° Be), 10 g of degreased cotton yarn were immersed and reacted therein at 80° C. for 2 hours. The treated yarn was then washed with hot water and then with water to remove the unreacted monomer and homopolymer which was not linked to the yarn, and dried to obtain modified cotton yarn having a graft degree of 10.87%.

EXAMPLE 2

Into an aqueous solution (150 ml) containing 0.3% of hydrogen peroxide, 0.02% of ferrous sulfate ($FeSO_4 \cdot 7H_2O$), 1.3% of methacrylic acid, 0.03% a sequestering agent (CHELEST NTB)® and 0.067% of sulfuric acid (50° Be), 10 g of viscose rayon staple fibers were immersed and reacted therein at 80° C. for 2 hours. The treated staple was then washed with hot water and then with water, and dried to obtain modified staple fibers having a graft degree of 9.30%.

EXAMPLE 3

Example 2 was repeated in the same manner as described except that hemp (ramie fiber) was used in lieu of the rayon staple. The modified hemp had a graft degree of 8.7%.

EXAMPLE 4

Into an aqueous solution (150 ml) containing 0.3% of hydrogen peroxide, 0.02% of ferrous sulfate, 1.5% of methacrylic acid, 0.03% a sequestering agent (CHELEST NTB®) and 0.06% of sulfuric acid (50° Be), 10 g of acrylic fibers (CASHIMIRON 3D×76V GK® manufactured by Asahi Kasei Kogyo Co., Ltd.) were immersed. The mixture was gradually heated from room temperature to 100° C. and maintained at that temperature for 1 hour. The treated fibers were washed well with water and dried to obtain modified acrylic fibers having a graft degree of 10.6%.

EXAMPLE 5

Into an aqueous solution (100 ml) containing 0.5% of hydrogen peroxide, 0.02% of ferrous sulfate, 2.5% of methacrylic acid, 0.05% a sequestering agent (CHELEST NTB®) and 0.1% of sulfuric acid (50° Be), 10 g of acrylic fibers (KANFBO ACRYL® WQ-i 1.8D×76 mm, manufactured by Kanebo Co., Ltd.) were immersed. The mixture was gradually heated from room temperature to 100° C. and maintained at that temperature for 1 hour. The treated fibers were washed well with water and dried to obtain modified acrylic fibers having a graft degree of 10.1%.

EXAMPLE 6

Into an aqueous solution (150 ml) containing 0.5% of hydrogen peroxide, 0.02% of ferrous sulfate, 3% of methacrylic acid, 0.05% a sequestering agent (CHELEST NTB®) and 0.05% of sulfuric acid (50° Be), 10 g of acrylic fibers (TORAYLON® 5×18 mm, manufactured by Toray Co., Ltd. ) were immersed. The mixture was gradually heated from room temperature to 100° C. and maintained at that temperature for 1 hour. The treated fibers were washed well with water and dried to obtain modified acrylic fibers having a graft degree of 9.6%.

EXAMPLE 7

Example 6 was repeated in the same manner as described except that roodacrylic fibers (KANEBO ACRYL VE1® manufactured by Kanebo Co., Ltd. ) was substituted for TORAYLON®. The modified acrylic fibers thus obtained had a graft degree of 8.1%.

EXAMPLE 8

Example 4 was repeated in the same manner as described except that 2-hydroxyethyl methacrylate was substituted for methacrylic acid. The modified acrylic fibers thus obtained had a graft degree of 9.3%.

EXAMPLE 9

Into an aqueous solution (100 ml) containing 0.5% of hydrogen peroxide, 0.02% of ferrous sulfate, 1.5% of methacrylic acid, 1.5% of 2-hydroxyethyl methacrylate, 0.05 a sequestering agent (CHELEST NTB®) and 0.1% of sulfuric acid (50° Be), 10 g of acrylic yarn (SILPALDN® 100d/–48f, manufactured by Mitsubishi Rayon Co., Ltd.) were immersed. The mixture was gradually heated from room temperature to 100° C. and maintained at that temperature for 1 hour. The treated fibers were washed well with water and dried to obtain modified acrylic yarn weighing 114% of the raw material yarn. The analysis of the carboxylic group revealed that the modified yarn had a grafted methacrylic acid monomer content of 6.4%.

I claim:

1. A modified fiber comprising a fiber substrate, said fiber substrate formed of a homopolymer of acrylonitrile or a copolymer of acrylonitrile with a vinyl comonomer, and a graft comonomer graft-copolymerized to said substrate fiber in an amount of 3–60% by weight based on the weight of said substrate fiber, said graft comonomer being at least one member selected from the group consisting of methacrylic acid and hydroxyalkyl methacrylates.

2. A modified fiber as claimed in claim 1, wherein said fiber is formed of said copolymer comprising an acrylonitrile content of at least 20% by weight and wherein said vinyl comonomer is selected from the group consisting of methyl acrylate, vinyl acetate, acrylic acid, methacrylic acid, vinyl chloride, vinylidene chloride, methylvinylpyridine and styrenesuifonic acid.

3. A modified fiber as claimed in claim 1, wherein said graft comonomer a hydroxyalkyl methacrylate selected from the group consisting of is 2-hydroxyethyl methacrylate and 2-hydroxypropyi methacrylate.

* * * * *

UNITED STATES PATENT AND TRADEMARK OFFICE

CERTIFICATE OF CORRECTION

PATENT NO. : 5,487,942

DATED : January 30, 1996

INVENTOR(S) : GOMIBUCHI

It is certified that error appears in the above-indentified patent and that said Letters Patent is hereby corrected as shown below:

Col. 1, line 47, "am" should read --an--;
line 58, "comohomer" should read --comonomer--.

Col. 2, line 18, "comohomer" should read --comonomer--;
line 26, "comohomer" should read --comonomer--.

Col. 3, line 65, "NTB)®" should read --NTB®)--.

Col. 4, line 29, "KANFBO" should read --KANEBO--;
line 51, "roodacrylic" should read --modacrylic--;
line 66, "0.05" should read --.05%--.

Col. 5, line 1, "SILPALDN" should read --SILPALON--.

Col. 6, line 10, "styrenesuifonic" should read --styrenesulfonic--;
line 14, "2-hydroxypropyi" should read --2-hydroxypropyl--.

UNITED STATES PATENT AND TRADEMARK OFFICE

CERTIFICATE OF CORRECTION

PATENT NO. : 5,487,942

DATED : January 30, 1996

INVENTOR(S) : GOMIBUCHI

It is certified that error appears in the above-indentified patent and that said Letters Patent is hereby corrected as shown below:

Col. 6, line 12, insert --is-- before "a" line 13, delete --is--.

Signed and Sealed this

Twenty-ninth Day of October 1996

*Attest:*

Bruce Lehman

BRUCE LEHMAN

*Attesting Officer*

*Commissioner of Patents and Trademarks*